US006039294A

United States Patent [19]

Chen

[11] Patent Number: 6,039,294

[45] Date of Patent: Mar. 21, 2000

[54] SUPPORT LEG FOR PARTITION WALLS

[76] Inventor: Waterson Chen, No. 477, Kuo-Kuang Rd., Nan Dist., Taichung City, Taiwan

[21] Appl. No.: 09/007,279

[22] Filed: Jan. 14, 1998

[51] Int. Cl.[7] ..... F16M 11/24

[52] U.S. Cl. ..... 248/188.4; 52/126.4; 52/239

[58] Field of Search ..... 248/650, 188.4; 52/126.4, 239

[56] References Cited

U.S. PATENT DOCUMENTS

| | | | |
|---|---|---|---|
| 3,150,853 | 9/1964 | Lisbin | 248/188.4 |
| 4,229,917 | 10/1980 | Textoris et al. | 52/239 |
| 4,485,602 | 12/1984 | Flamboe, Jr. et al. | 52/126.4 X |
| 4,991,365 | 2/1991 | Jackson | 52/239 X |
| 5,092,550 | 3/1992 | Bettini | 248/188.4 |
| 5,542,219 | 8/1996 | Dias | 248/188.4 X |

*Primary Examiner*—Derek J. Berger
*Attorney, Agent, or Firm*—Kenyon & Kenyon

[57] ABSTRACT

A support leg has a unitary one-piece molded body which includes an upper fitting portion to be fitted into a vertical side of a partition wall. The upper fitting portion has two opposing vertical plate portions, a plurality of U-shaped bends which extend from the vertical plate portions to bend about a common vertical axis and which are spaced vertically, a plurality of horizontal grooves defined by the adjacent bends, and limit blocks formed on the vertical plate portions within the horizontal grooves. A lower sleeve portion extends downward from the upper fitting portion and has a female screw portion adjacent to the upper fitting portion, and a tubular portion with a bore of uniform cross-section that extends coaxially downward from the female screw portion. A horizontal abutment portion projects from the lower sleeve portion below the upper fitting portion for abutting against the bottom end of the partition wall. The horizontal abutment portion has an engagement groove and an engagement projection. The support leg further has a height adjustment foot member threadedly inserted into the lower sleeve portion.

1 Claim, 8 Drawing Sheets

SUPPORT LEG FOR PARTITION WALLS

BACKGROUND OF THE INVENTION

1. Field of the Invention

This invention relates to a support leg for partition walls, more particularly to a support leg adapted to be attached to a bottom corner of partition walls for adjusting the height of the same.

2. Description of the Related Art

Referring to FIG. 1, a conventional support leg 200 is usually attached to a bottom corner of a partition wall 100. A foot member 300 is threadedly inserted into the support leg 200 to adjust the distance between the bottom end of the partition wall 100 and the floor. With reference to FIGS. 2 and 3, the conventional support leg 200 includes a main body 201 and a horizontal abutment member 202. The main body 201 is made by forging, and has two vertically spaced U-shaped insert bends 203 at the upper portion 201*a* to confine two horizontal grooves 204 for insertion into a vertical side of the partition wall 100. A plurality of blocks 211 are formed in two sides of the grooves 204 to limit inward extension of the insert bends 203 into the partition wall 100. The main body 201 further has a sleeve 207 at the lower portion for insertion of the foot member 300. The horizontal abutment member 202 has an extension 208 which is welded to the main body 201 and the upper portion 201*a*. An internal screw thread 209 is formed for adjustable engagement with the foot member 300. Two abutment plates 210 are welded to the horizontal abutment member 202 so that the horizontal abutment member 202 can engage another support leg 200.

Since the conventional support leg 200 is made by punching, forging and welding, it is difficult to control the quality of the product. That is, forming of the sleeve 207 so as to be coaxial with the internal screw thread 209 and the insert bends 203 is difficult, whereby the foot member 300 tends to interfere with the inner peripheral walls of the sleeve 207 and the insert bends 203. Insertion of the foot member 300 is therefore adversely affected.

SUMMARY OF THE INVENTION

The object of the present invention is to provide a support leg with a unitary one-piece mold body to overcome the aforementioned problem associated with the prior art.

According to this invention, a support leg has a unitary one-piece molded body which includes an upper fitting portion adapted for fitting into a vertical side of a partition wall. The upper fitting portion has two opposing vertical plate portions, a plurality of U-shaped bends which extend from the vertical plate portions to bend substantially about a common vertical axis and which are spaced vertically, a plurality of horizontal grooves each being defined by adjacent two of the bends, and limit blocks formed on the vertical plate portions within the horizontal grooves. A lower sleeve portion extends downward from the upper fitting portion and has a female screw portion adjacent to the upper fitting portion, and a tubular portion with a bore of substantially uniform cross-section that extends coaxially downward from the female screw portion. A horizontal abutment portion projects from the lower sleeve portion immediately below the upper fitting portion and is adapted to abut against the bottom end of the partition wall. The horizontal abutment portion has an engagement groove and an engagement projection. The support leg further has a height adjustment foot member threadedly inserted into the lower sleeve portion.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
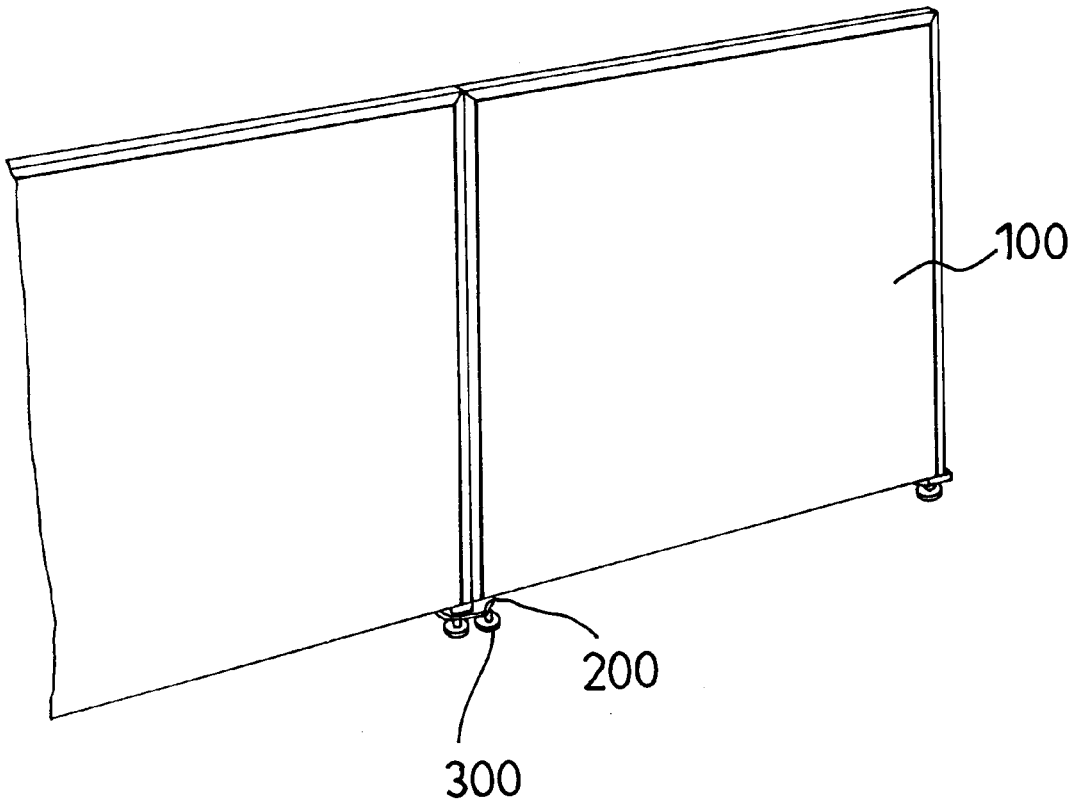
FIG.1 PRIOR ART
FIG. 1 is a schematic view of a conventional support leg for supporting partition walls.
Figure 2:
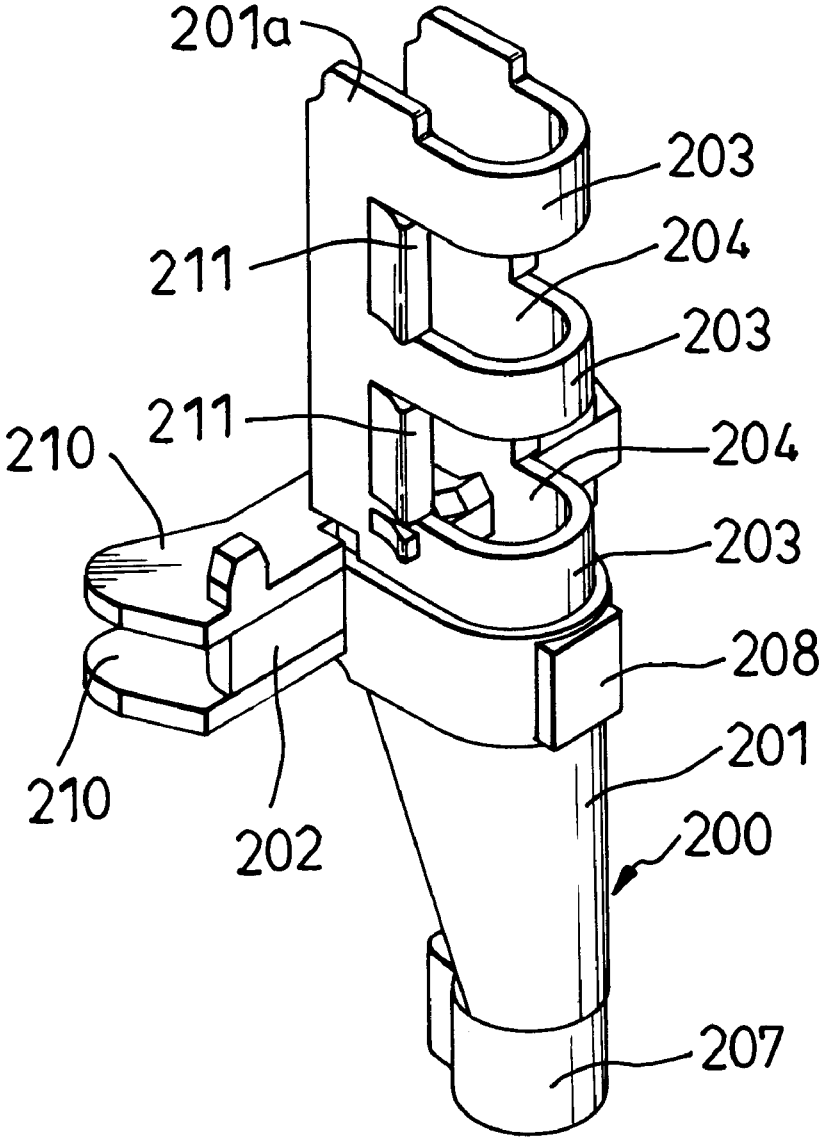
FIG.2 PRIOR ART
FIG. 2 is a perspective view of the conventional support leg.
Figure 3:
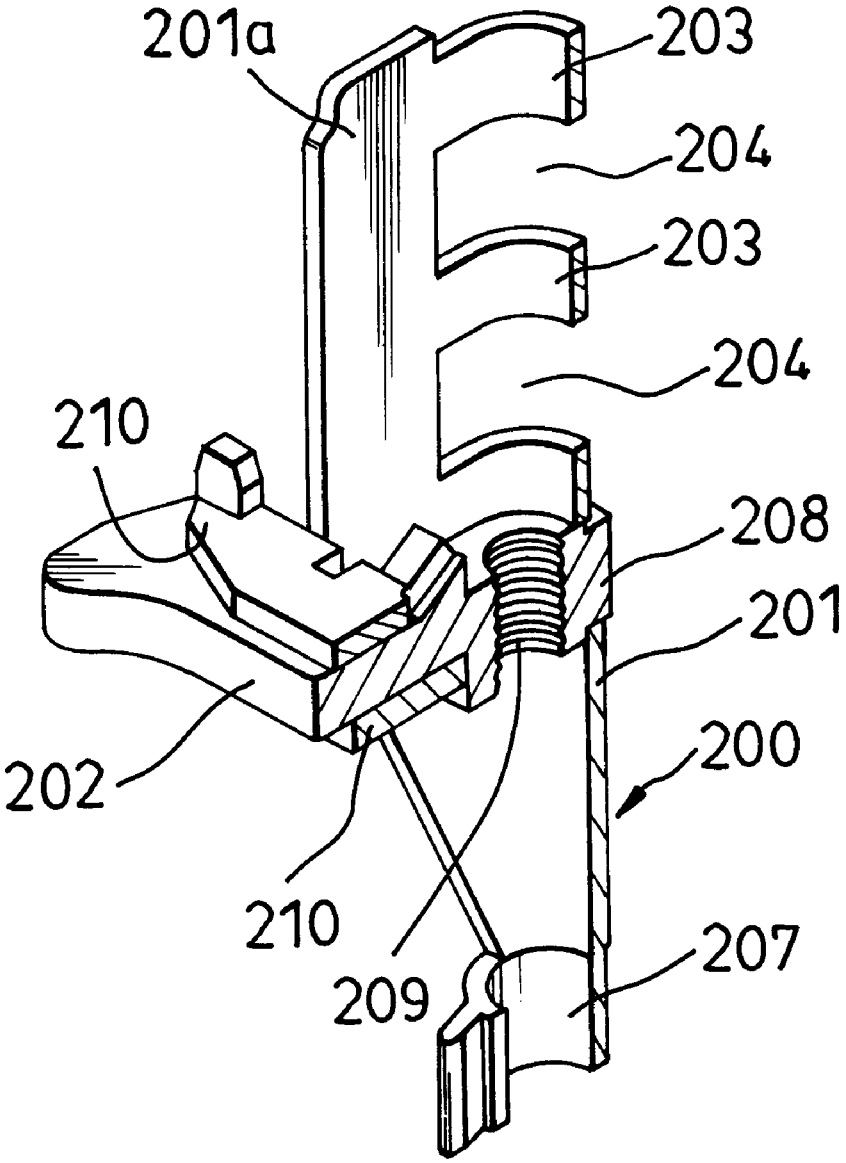
FIG.3 PRIOR ART
FIG. 3 is a partially sectioned view of the conventional support leg.
Figure 4:
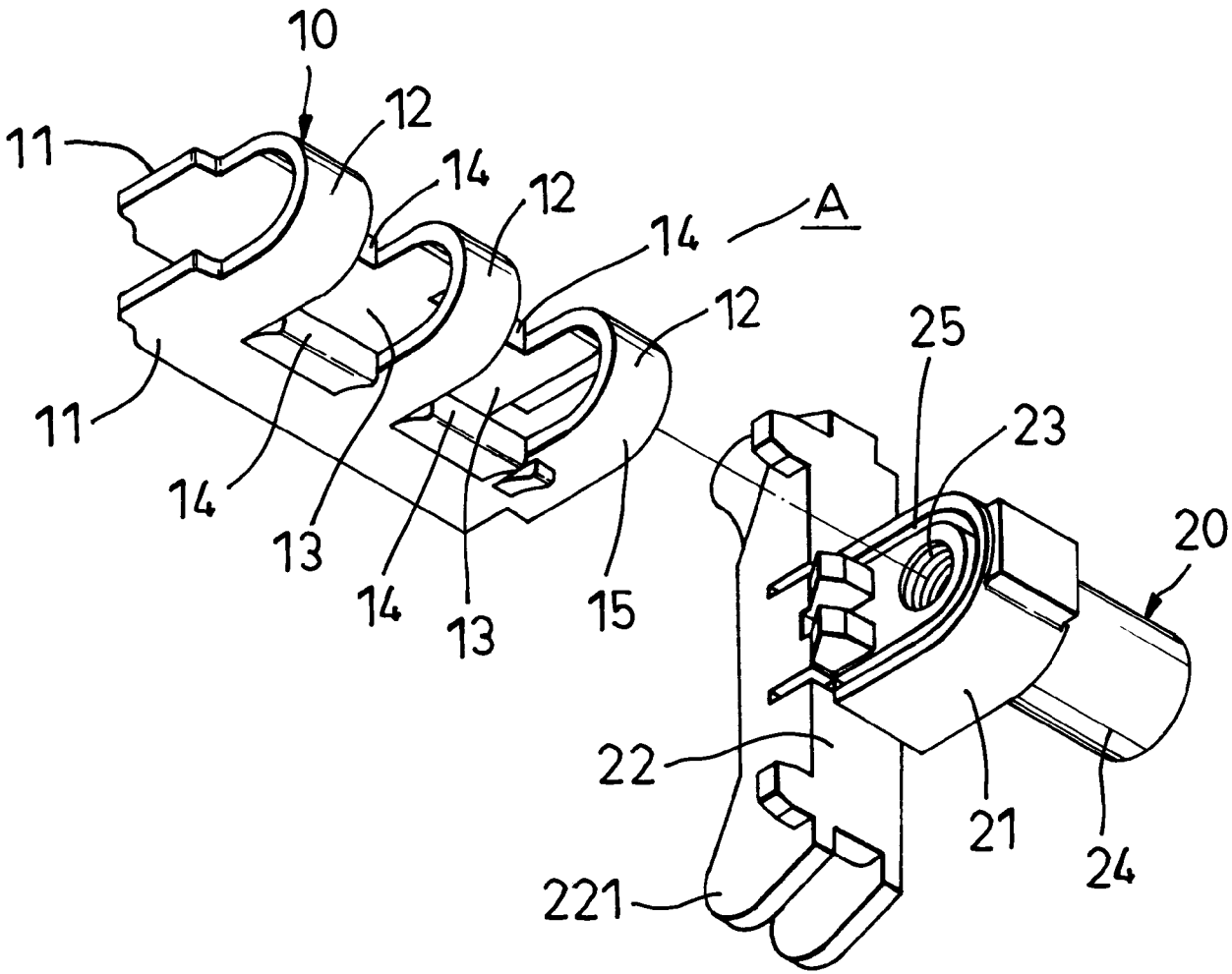
FIG. 4 is an exploded view of a support leg wax pattern for an investment casting of a preferred embodiment of a support leg according to the present invention.
Figure 5:
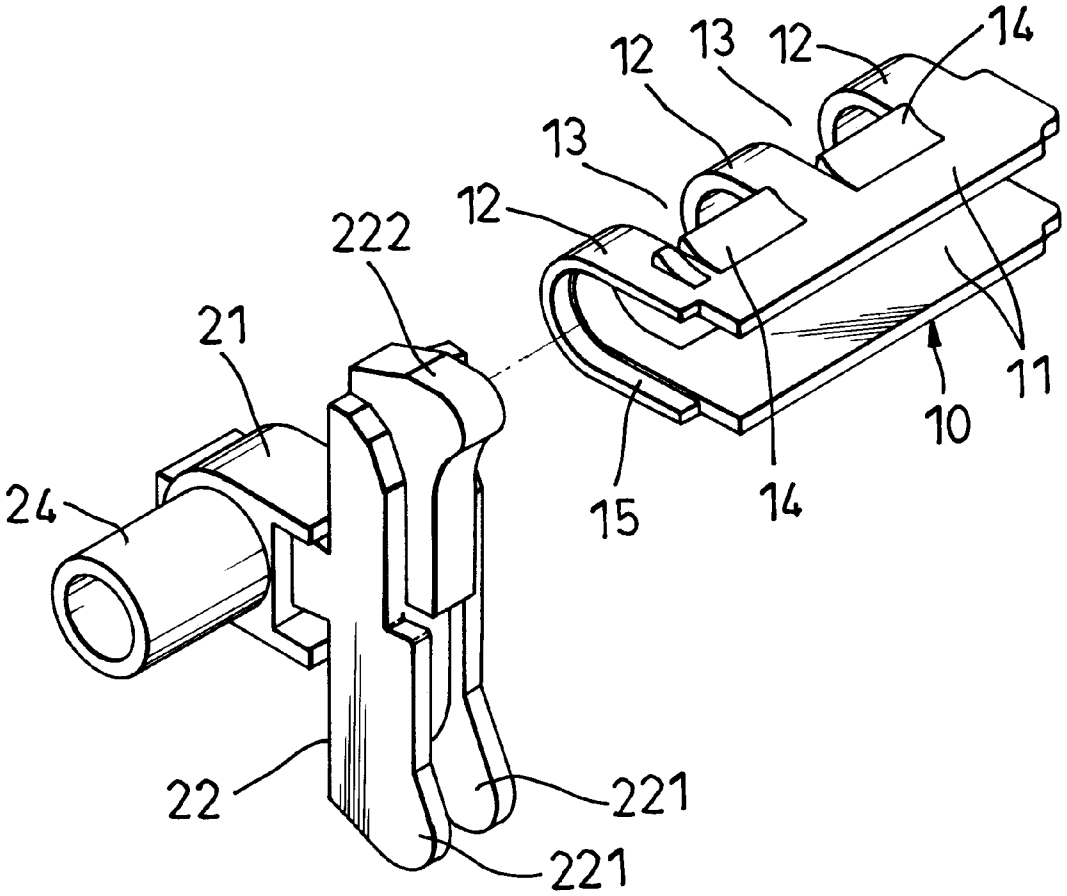
FIG. 5 is an exploded view similar to FIG. 4 but viewed from another angle.

Referring to FIGS. 4 and 5, the support leg wax pattern (A) used in the present invention is shown to comprise a fitting portion 10. The fitting portion 10 has three U-shaped bends 12 which are bent substantially about a common axis and which are spaced apart from each other so as to define two grooves 13. Two opposing plate portions 11 interconnect integrally the bends 12. Four limit blocks 14 are formed on the plate portions 11 within the grooves 13. One of the bends 12 is formed with a protruder 15.

The support leg wax pattern (A) further includes a sleeve portion 20 and an abutment portion 22. The sleeve portion 20 has a U-shaped part 21 for connection with the protruder 15 of the U-shaped bends 12, and a U-shaped groove 25 to receive the protruder 15. A female screw portion 23 is formed in the U-shaped part 21. A hollow portion 24 extends from the U-shaped part 21 and is coaxial with the female screw portion 23. The abutment portion 22 projects from the U-shaped part 21, and has two projecting plate parts 221 and a projecting part 222.

Figure 6:
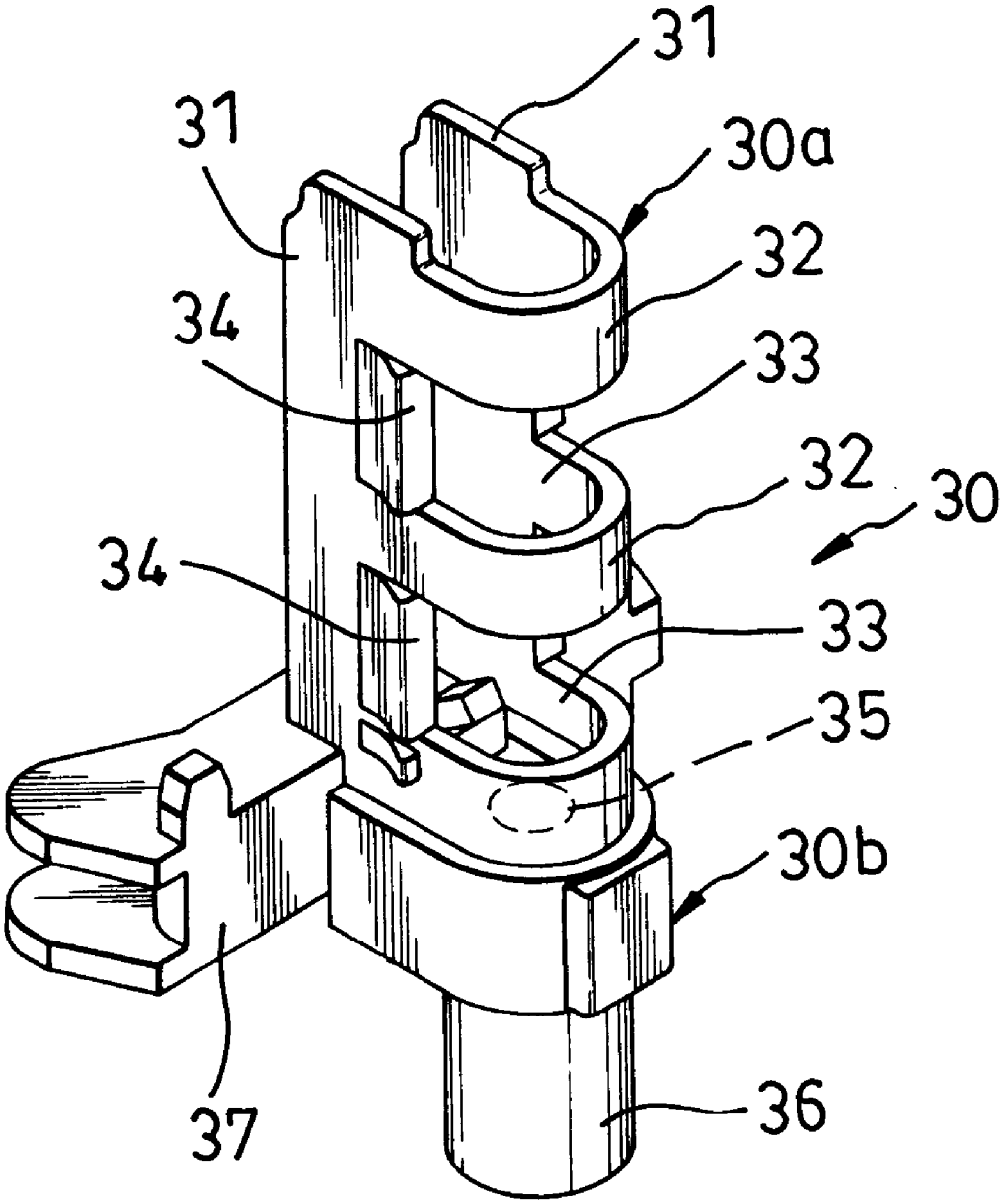
FIG. 6 is a perspective view of the support leg according to the preferred embodiment.

The fitting portion 10 and the sleeve portion 20 are made from wax. With reference to FIG. 6, after the protruder 15 engages the U-shaped groove 25, the assembly of the fitting portion 10 and the sleeve portion 20 is then placed into a mold for proceeding with an investment casting process. The mold of the investment casting can provide a unitary support leg 30 shown in FIGS. 6 and 7, which is identical to the wax pattern (A) . The support leg 30 as made has a high dimensional accuracy, and includes a unitary upper fitting portion 30*a* and a lower sleeve portion 30*b*. The upper fitting portion 30*a* has two opposing vertical plate portions 31, a plurality of U-shaped bends 32 which extend from the vertical plate portions 31 to bend substantially about a common vertical axis and which are spaced vertically, a plurality of horizontal grooves 33 each being confined by adjacent two of the bends 32, and limit blocks 34 which are formed on the vertical plate portions 31 within the horizontal grooves 33. The lower sleeve portion 30*b* extends downward from the upper fitting portion 30*a* and has a female screw portion 35 adjacent to the upper fitting portion 30*a*, and a tubular hollow portion 36 with a bore 361 of substantially uniform cross-section that extends coaxially downward from the female screw portion 35. A horizontal abutment portion 37 projects from the lower sleeve portion 30*b* immediately below the upper fitting portion 30*a*. The horizontal abutment portion 37 has an engagement groove 371 and an engagement projection 372.

Figure 7:
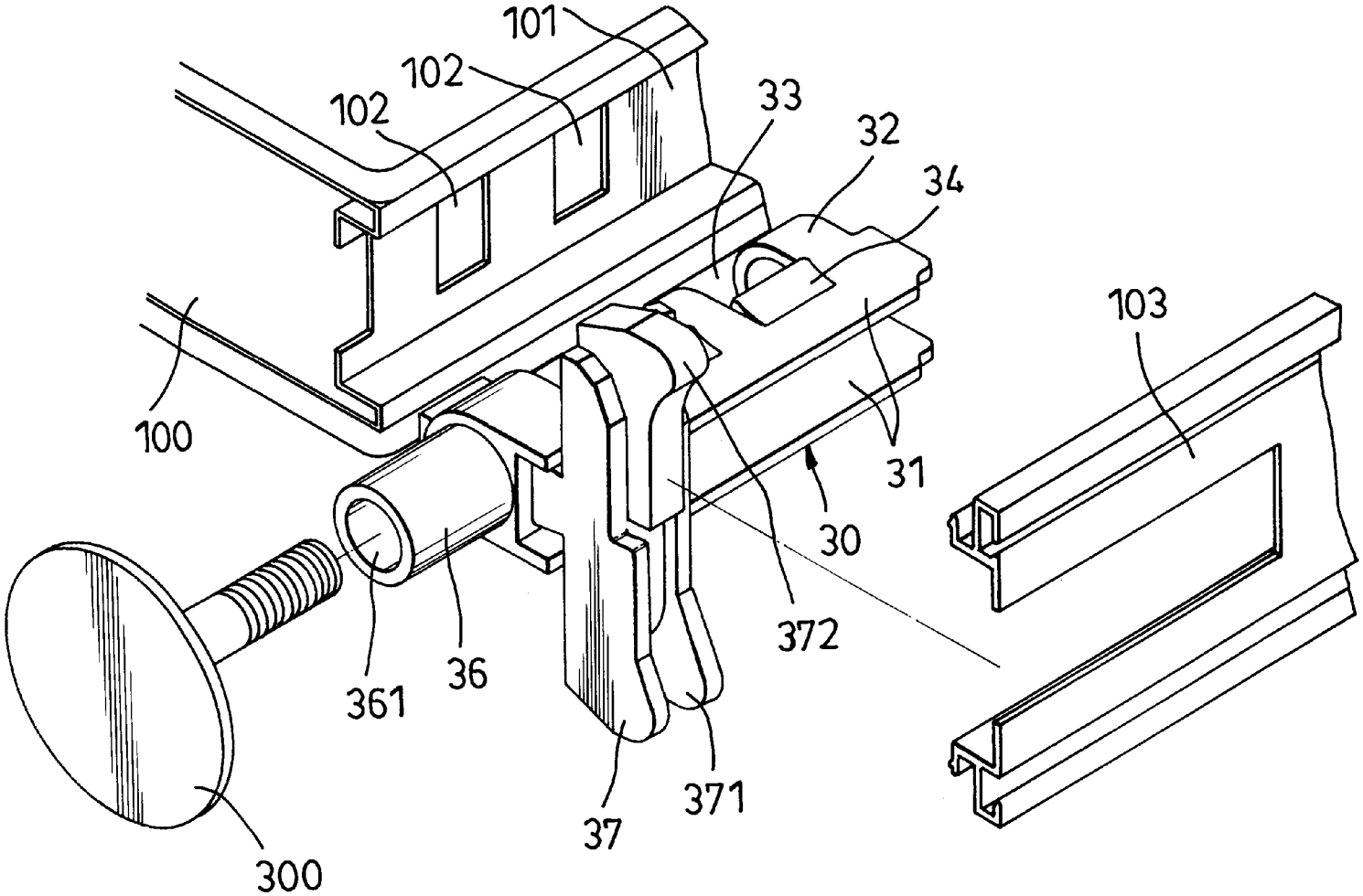
FIG. 7 is a perspective view showing how the support leg of the preferred embodiment is mounted to a partition wall.

Referring to FIG. 7, the support leg 30 is adapted to be attached to a bottom corner of a vertical partition wall 100. The U-shaped insert bends 32 are inserted into notches 102 formed in a vertical side 101 of the partition wall 100, and are prevented from further extension therein by the limit blocks 34. A vertical cover plate 103 is mounted on the vertical side 101 to cover the support leg 30. The horizontal abutment portion 37 abuts against the bottom end of the partition wall 100. A height adjustment foot member 300 is threadedly inserted into the lower sleeve portion 36.

Figure 8:
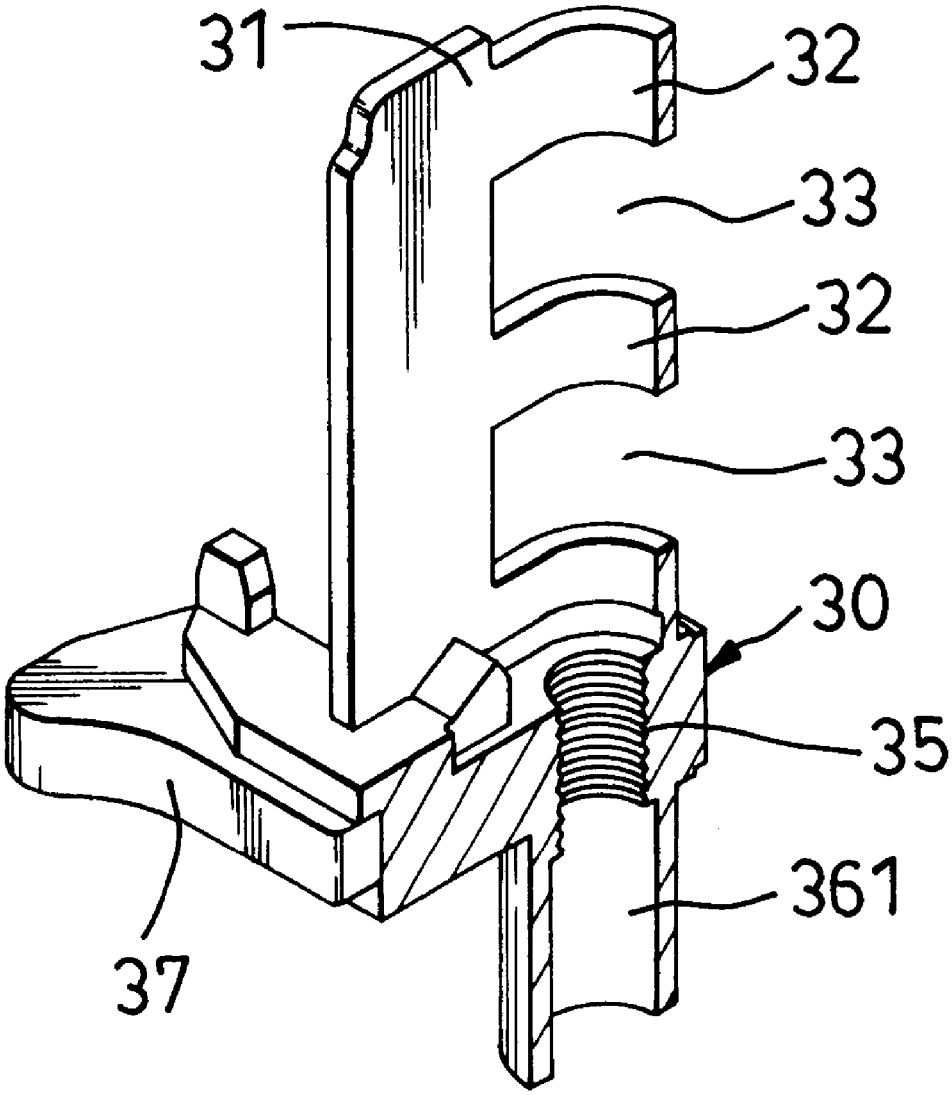
FIG. 8 is a partially sectioned view of the support leg of the preferred embodiment.

As shown in FIG. 8, since the support leg 30 is of a unitary one-piece molded body, and since the female screw portion 35 and the hollow portion 36 are coaxial, when the foot member 300 extends upward from the hollow portion 36, it can threadedly engage the female screw portion 35 without deviation. In addition, because the support leg 30 is made by the investment casting process, it has accurate dimensions at both inner and outer sides thereof. No welding step is necessary in making the support leg 30. Moreover, by means of the investment casting, the limit blocks 34 can be enlarged and reinforced as compared to the conventional support leg which is made by punching and forging.

Note that a one-piece wax pattern can be used to replace the support leg wax pattern (A) which is formed from the fitting portion 10 and the sleeve portion 20.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A support leg adapted to be attached to a bottom corner of a vertical partition wall which has a horizontal bottom end and a vertical side meeting the horizontal bottom end at the bottom corner, said support leg comprising:

a unitary one-piece molded body which includes:

an upper fitting portion adapted for fitting into the vertical side of the partition wall, said upper fitting portion having two opposing vertical plate portions, a plurality of U-shaped bends which extend from said vertical plate portions to bend substantially about a common vertical axis and which are spaced vertically, a plurality of horizontal grooves each being defined by adjacent two of said bends, and limit blocks formed on said vertical plate portions within said horizontal grooves;

a lower sleeve portion extending downward from said upper fitting portion and having a female screw portion adjacent to said upper fitting portion, and a tubular portion extending downward from said female screw portion;

a horizontal abutment portion projecting from said lower sleeve portion immediately below said upper fitting portion and adapted to abut against the bottom ends of the partition wall, said horizontal abutment portion having an engagement groove and an engagement projection; and a height adjustment threaded foot member for insertion into said tubular portion and for engagement with said female screw portion;

said tubular portion being cylindrical and having a non-threaded cylindrical bore with a bottom open end for entrance of said foot member, said female screw portion having a cylindrical screw hole for engaging threadedly said foot member above said cylindrical bore, said screw hole having a lower end connected to said cylindrical bore, said cylindrical bore having a constant cross-section from said bottom open end to said lower end of said screw hole and being coaxial with said screw hole.

* * * * *